US006520130B2

(12) United States Patent
Chiappini et al.

(10) Patent No.: US 6,520,130 B2
(45) Date of Patent: Feb. 18, 2003

(54) INTERNAL-COMBUSTION ENGINE WITH HYDRAULIC SYSTEM FOR VARIABLE OPERATION OF THE VALVES AND WITH MEANS FOR BLEEDING THE HYDRAULIC SYSTEM

(75) Inventors: Stefano Chiappini, Orbassano (IT); Andrea Pecori, Orbassano (IT); Francesco Vattaneo, Orbassano (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 0 days.

(21) Appl. No.: 10/102,924

(22) Filed: Mar. 22, 2002

(65) Prior Publication Data

US 2002/0134332 A1 Sep. 26, 2002

(30) Foreign Application Priority Data

Mar. 23, 2001 (IT) ..... T001A0273

(51) Int. Cl.[7] ..... F01L 9/02; F01L 13/00

(52) U.S. Cl. ..... 123/90.12; 123/90.57

(58) Field of Search ..... 123/90.12, 90.13, 123/90.15, 90.16, 90.48, 90.49, 90.55, 90.57

(56) References Cited

U.S. PATENT DOCUMENTS

| | | | | | |
|---|---|---|---|---|---|
| 5,127,375 | A | * | 7/1992 | Bowman et al. | 123/90.12 |
| 5,275,136 | A | * | 1/1994 | Schechter et al. | 123/90.12 |
| 6,112,710 | A | * | 9/2000 | Egan, III et al. | 123/90.12 |
| 6,325,028 | B1 | * | 12/2001 | Albanello et al. | 123/90.12 |

* cited by examiner

*Primary Examiner*—Weilun Lo
(74) *Attorney, Agent, or Firm*—Sughrue Mion, PLLC

(57) ABSTRACT

In an internal-combustion engine with a hydraulic system for variable operation of the valves, associated to the tappet controlled by each cam of the cam shaft is a passage for bleeding the hydraulic system.

3 Claims, 3 Drawing Sheets

INTERNAL-COMBUSTION ENGINE WITH HYDRAULIC SYSTEM FOR VARIABLE OPERATION OF THE VALVES AND WITH MEANS FOR BLEEDING THE HYDRAULIC SYSTEM

BACKGROUND OF THE INVENTION

The present invention relates to internal-combustion engines of the type comprising:

at least one induction valve and at least one exhaust valve for each cylinder, each valve being provided with respective elastic means that bring back the valve into the closed position to control communication between the respective induction and exhaust ducts and the combustion chamber;

a camshaft for operating the induction and exhaust valves of the cylinders of the engine by means of respective tappets, each induction valve and each exhaust valve being actuated by a cam of said camshaft;

in which at least one of said tappets controls the respective induction or exhaust valve against the action of said elastic return means via the interposition of hydraulic means including a hydraulic chamber containing fluid under pressure;

said hydraulic chamber containing fluid under pressure being connectable, via a solenoid valve, to an outlet channel for decoupling the valve from the respective tappet and causing fast closing of the valve under the action of respective elastic return means;

said hydraulic means further comprising a piston associated to the stem of the valve and slidably mounted in a guide bushing, said piston being set facing a variable-volume chamber defined by the piston inside the guide bushing, said variable-volume chamber being in communication with the hydraulic chamber containing fluid under pressure by means of an end aperture of said guide bushing, said piston having an end appendage designed to be inserted into said end aperture during the final stretch of the closing stroke of the valve in order to restrict the communication port between said variable-volume chamber and said hydraulic chamber containing fluid under pressure, so as to slow down the stroke of the valve in the proximity of its closing.

An engine of the type referred to above is, for example, described and illustrated in the European patent applications Nos. EP-A-0 803 642 and EP-A-1 091 097 filed by the present applicant.

Studies and tests carried out by the present applicant have shown that some problems may arise during operation, particularly at engine starting. When the engine has not been running for a long time, in fact, the hydraulic circuit of the valve-control system is emptied of oil under pressure. When the engine is restarted, the pump for feeding oil under pressure again sends the oil to fill the circuit, at the same time causing the air present in the circuit to come out. The air-bleed ways are, however, relatively few, which means that there is a delayed response of the system.

SUMMARY OF THE INVENTION

The purpose of the present invention is to overcome the above-mentioned problem.

With a view to achieving this purpose, the subject of the invention is an engine having all the characteristics referred to at the beginning of the present description and moreover characterized in that it comprises at least one passage for bleeding the hydraulic circuit, which sets the pressure chamber associated to each tappet actuated by the camshaft in communication with the outside environment, this passage being intercepted and closed following upon a displacement of the tappet from its resting position.

In one first embodiment, the bleed passage is defined between a flattened portion of the cylindrical surface of the tappet and the cylindrical wall of a bushing within which the tappet is slidably mounted. This solution presents the advantage that the bleed passage can be easily pre-set in the most favourable position by angular orientation of the tappet. This is advantageous if the tappet has an axis that is inclined with respect to the vertical in so far as the passage must be set on the higher side of the tappet.

In a second embodiment, the passage is made in the body of the bushing within which the tappet is slidably mounted, and the latter has an end portion of reduced diameter that defines an annular chamber into which the aforesaid passage comes out when the tappet is in its resting position, whereas the said passage is intercepted by the main portion, i.e., the wider portion, of the tappet when the latter moves away from its resting position. Alternatively, the passage may be defined by a slit in the guide bushing.

Of course, various other conformations and arrangements of the bleed passage are possible.

BRIEF DESCRIPTION OF THE DRAWINGS

Further characteristics and advantages of the present invention will emerge from the ensuing description, with reference to the attached drawings, which are provided purely by way of non-limiting examples, and in which.

DETAILED DESCRIPTION OF THE INVENTION

Figure 1:
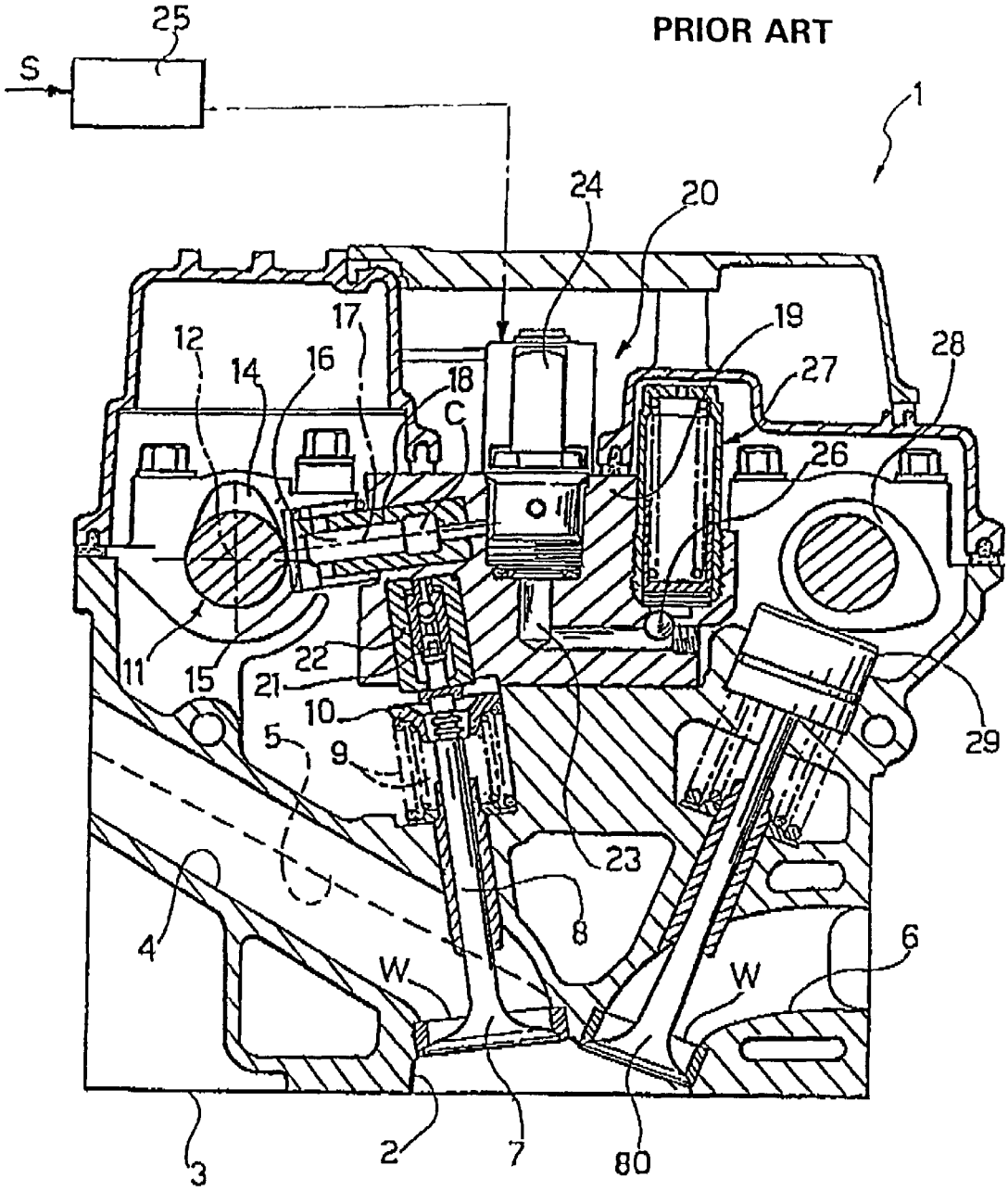
FIG. 1 PRIOR ART
FIG. 1 is a cross-sectional view of the cylinder head of an internal-combustion engine according to the embodiment known from the European patent application EP-A-0 803 642 filed by the present applicant.

With reference to FIG. 1, the internal-combustion engine described in the prior European patent application No. EP-A-0 803 642, as well as in EP-A-1 091 097, filed by the present applicant is a multicylinder engine, for example, an engine with five cylinders set in line, comprising a cylindrical head 1.

The head 1 comprises, for each cylinder, a cavity 2 formed in the base surface 3 of the head 1, the said cavity 2 defining the combustion chamber into which two induction ducts 4, 5 and two exhaust ducts 6 give out. Communication of the two induction ducts 4, 5 with the combustion chamber 2 is controlled by two induction valves 7 of the traditional poppet or mushroom type, each comprising a stem 8 slidably mounted in the body of the head 1. Each valve 7 is brought back to the closing position by springs 9 set between an inner surface of the head 1 and an end cup 10 of the valve. Opening of the induction valves 7 is controlled, in the way that will be described in what follows, by a camshaft 11 which is slidably mounted about an axis 12 within supports of the head 1 and which comprises a plurality of cams 14 for operating the valves.

Each cam 14 for operating an induction valve 7 cooperates with the cap 15 of a tappet 16 slidably mounted along an axis 17, which in the case illustrated is directed substantially at 90° with respect to the axis of the valve 7 (the tappet may also be mounted so that it is aligned, as will be illustrated with reference to FIG. 3), within a bushing 18 carried by a body 19 of a pre-assembled subassembly 20 that incorporates all the electrical and hydraulic devices associated to operation of the induction valves, according to what is illustrated in detail in what follows. The tappet 16 is able to transmit a thrust to the stem 8 of the valve 7 so as to cause opening of the latter against the action of the elastic means 9 via fluid under pressure (typically oil coming from the engine-lubrication circuit) present in a chamber C and a piston 21 slidably mounted in a cylindrical body constituted by a bushing 22, which is also carried by the body 19 of the subassembly 20. Again according to the known solution illustrated in FIG. 1, the chamber C containing fluid under pressure associated to each induction valve 7 can be set in communication with an outlet channel 23 via a solenoid valve 24. The solenoid valve 24, which may be of any known type suitable for the function illustrated herein, is controlled by electronic control means, designated as a whole by 25, according to the signals S indicating operating parameters of the engine, such as the position of the accelerator and the engine r.p.m. When the solenoid valve 24 is opened, the chamber C enters into communication with the channel 23, so that the fluid under pressure present in the chamber C flows into said channel, and a decoupling of the tappet 16 of the respective induction valve 7 is obtained, the said induction valve 7 then returning rapidly into its closed position under the action of the return spring 9. By controlling the communication between the chamber C and the outlet channel 23, it is therefore possible to vary the opening time and opening stroke of each induction valve 7 as desired.

The outlet channels 23 of the various solenoid valves 24 all open out into one and the same longitudinal channel 26, which communicates with one or more pressure accumulators 27, only one of which can be seen in FIG. 1. All the tappets 16 with the associated bushings 18, the pistons 21 with the associated bushings 22, and the solenoid valves 24 and the corresponding channels 23, 26 are carried and made in the aforesaid body 19 of the pre-assembled subassembly 20, to the advantage of speed and ease of assembly of the engine.

The exhaust valves 80 associated to each cylinder are controlled, in the embodiment illustrated in FIG. 1, in a traditional way by a camshaft 28 by means of respective tappets 29.

Figure 2:
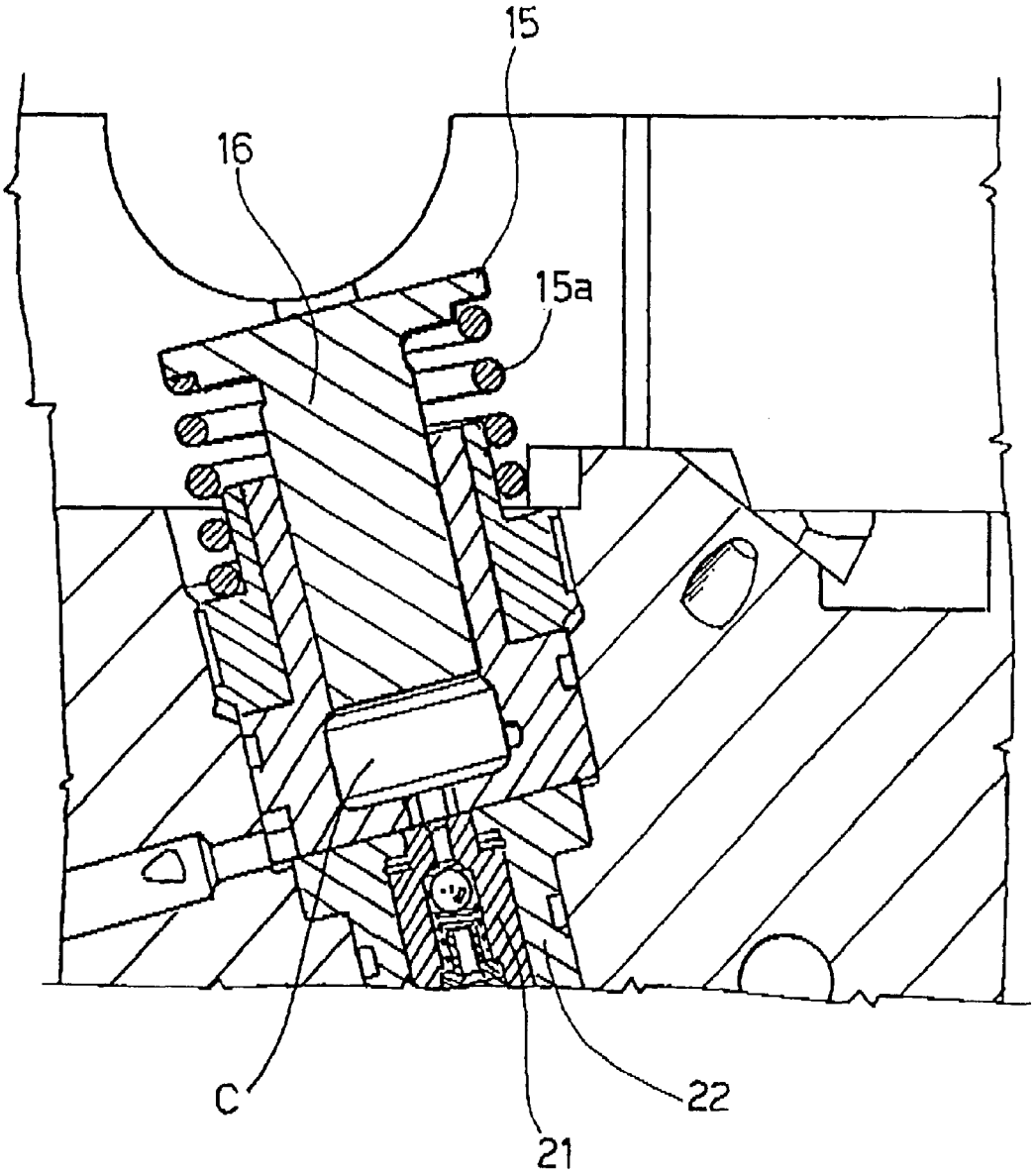
FIG. 2 PRIOR ART
FIG. 2 is a cross-sectional view at an enlarged scale of a detail of a simplified version of the engine according to the prior art.

FIG. 2 illustrates, at an enlarged scale, the body 19 of the pre-assembled subassembly.

FIG. 2 illustrates a simplified version of a variable-control valve, once more according to the known art, where the axis of the tappet 16 is aligned with the axis of the stem 8 of the valve (not illustrated). In FIG. 2, the parts in common with FIG. 1 are designated by the same reference numbers. Rotation of the cam (not illustrated in FIG. 2) causes a thrust on the cap 15 with a consequent lowering of the tappet 16 against the action of the spring 15*a*. The oil under pressure present in the chamber C consequently causes movement of the piston 21 that actuates the stem of the valve. The chamber C can be emptied of oil under pressure by means of the solenoid valve 24 (FIG. 1).

As already mentioned at the beginning of the present description, at starting of the engine after it has not been running for a long time, which has led to the oil coming out of the circuit, the oil-feed pump fills the circuit again, at the same time causing the air to come out of the chambers and out of the pipes communicating with the chamber C. In order to favour bleeding, the invention envisages a bleed passage associated to each tappet 16.

Figure 3:
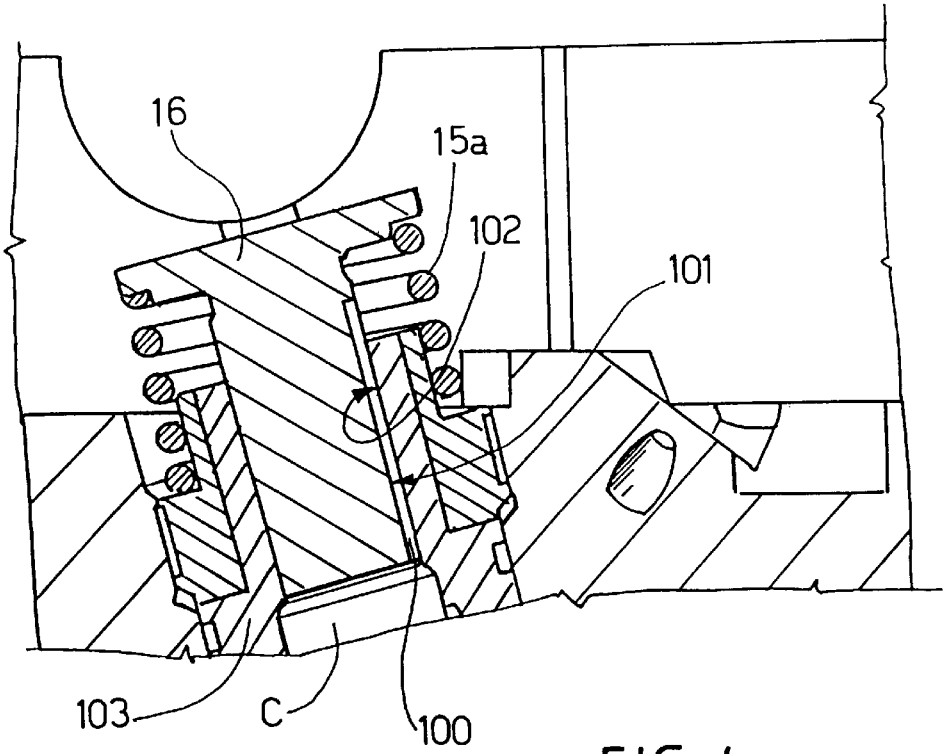
FIGS. 3 and 4 illustrate a detail of FIG. 2 according to two possible modifications that form the subject of the present invention.

In the case of the solution of FIG. 3, this passage, designated by 100, is made between one flattened portion 101 of the cylindrical wall of the tappet 16 and the internal cylindrical wall 102 of the bushing 18 within which the tappet is slidably mounted. This passage is intercepted and closed when the tappet moves away from its resting position (illustrated in the figure) by a distance sufficient to bring the top end of the passage 100 below the top end of the bushing 18.

Figure 4:
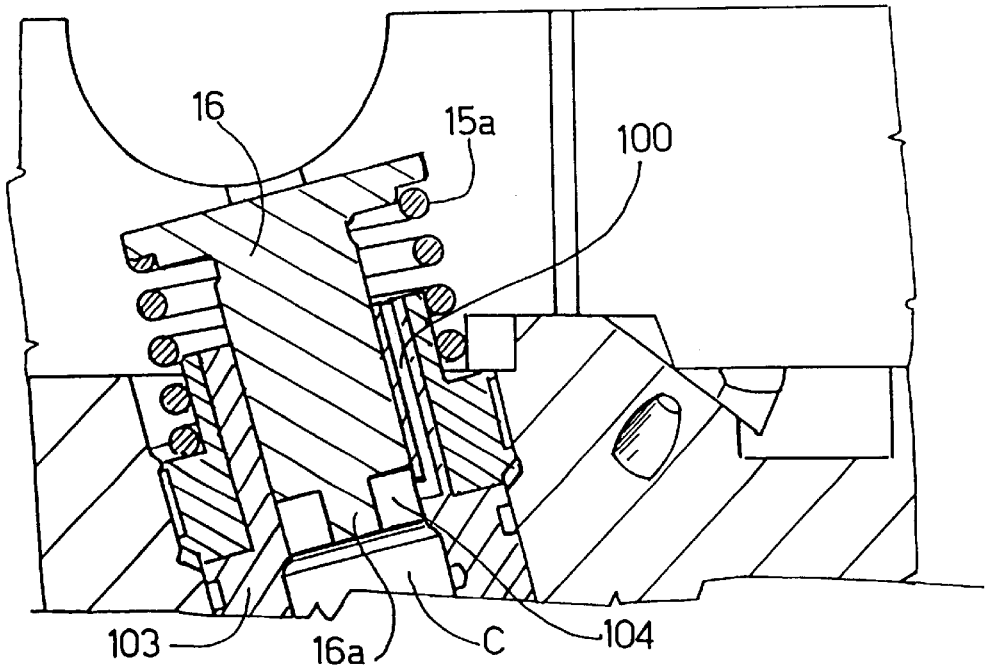

In the case of the solution of FIG. 4, the passage 100 is made in the bushing 103, and the tappet 16 has one end of reduced diameter 16a that defines an annular chamber 104 into which the passage 100 comes out. When the tappet 16 moves away from its resting position (illustrated in the figure), the outlet of the passage 100 is covered by the main portion, i.e., the one having a larger diameter, of the tappet 16.

What is claimed is:

1. An internal-combustion engine comprising:

at least one induction valve and at least one exhaust valve for each cylinder, each valve being provided with respective elastic means that brings back the valve into the closed position to control communication between the respective induction and exhaust ducts and the combustion chamber;

a camshaft for operating the induction and exhaust valves of the cylinders of the engine by means of respective tappets, each induction valve and each exhaust valve being actuated by a cam of said camshaft, in which at least one of said tappets controls the respective induction or exhaust valve against the action of said elastic return means via the interposition of hydraulic means including a hydraulic chamber (C) containing fluid under pressure;

said hydraulic chamber containing fluid under pressure being connectable, via a solenoid valve, to an outlet channel for decoupling the valve from the respective tappet and causing fast closing of the valve under the action of respective elastic return means;

said hydraulic means further comprising a piston associated to the stem of the valve and slidably mounted in a guide bushing, said piston being set facing a variable-volume chamber defined by the piston and the guide bushing, said variable-volume chamber being in communication with the hydraulic chamber (C) containing fluid under pressure by means of a communication port constituted by an end aperture of said guide bushing, said piston having an end appendage designed to be inserted into said end aperture during a final stretch of a closing stroke of the valve in order to restrict the communication port between said variable-volume chamber and said hydraulic pressure containing fluid under pressure, so as to slow down the stroke of the valve in proximity of its closing, wherein said engine comprises at least one passage for bleeding the hydraulic circuit, which sets the pressure chamber (C) associated to each tappet actuated by the camshaft directly in communication with the outside environment, said passage being intercepted and closed following upon a displacement of the tappet from its resting position.

2. The engine according to claim 1, wherein the bleed passage is defined between a flattened portion of a cylindrical surface of the tappet and a cylindrical wall of a bushing within which the tappet is slidably mounted.

3. The engine according to claim 1, wherein the bleed passage is made in a body of a bushing within which the tappet is slidably mounted, and the tappet has an end portion of reduced diameter that defines an annular chamber into which the bleed passage comes out when the tappet is in its resting position, whereas said bleed passage is intercepted by a main portion, which is wider than the end portion, of the tappet when the tappet moves away from its resting position.

* * * * *